US008820741B2

(12) United States Patent
Hongo et al.

(10) Patent No.: US 8,820,741 B2
(45) Date of Patent: Sep. 2, 2014

(54) PAPER CONVEYING APPARATUS, JAM DETECTION METHOD, AND COMPUTER-READABLE, NON-TRANSITORY MEDIUM

(71) Applicant: PFU Limited, Kahoku (JP)

(72) Inventors: Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/962,712

(22) Filed: Aug. 8, 2013

(65) Prior Publication Data

US 2014/0054853 A1 Feb. 27, 2014

(30) Foreign Application Priority Data

Aug. 24, 2012 (JP) ..... 2012-15273

(51) Int. Cl.
*B65H 7/12* (2006.01)

(52) U.S. Cl.
CPC ..... *B65H 7/12* (2013.01)
USPC .. 271/265.04; 271/263; 271/262; 271/258.01

(58) Field of Classification Search
CPC ..... B65H 7/12
USPC ..... 271/262, 263, 265.04, 258.01
See application file for complete search history.

(56) References Cited

U.S. PATENT DOCUMENTS 4,022,460 A 5/1977 Pritchett
6,314,054 B1 * 11/2001 Priebsch ..... 367/93
7,934,722 B2 * 5/2011 Namikawa ..... 271/265.04
8,567,777 B2 10/2013 Syracuse et al.
8,585,050 B2 11/2013 Syracuse et al.
8,657,285 B2 * 2/2014 Matsuoka et al. ..... 271/265.04
2003/0006550 A1 1/2003 Chujo et al.
2005/0269759 A1 12/2005 Sano et al.

(Continued)

FOREIGN PATENT DOCUMENTS

JP 57-169767 10/1982
JP 60-112547 6/1985

(Continued)

OTHER PUBLICATIONS

Office action mailed Jul. 9, 2013 for JP 2012-185273 including English translation, 7pp.

(Continued)

*Primary Examiner* — Luis A Gonzalez
(74) *Attorney, Agent, or Firm* — Christie, Parker & Hale, LLP

(57) ABSTRACT

There are provided a paper conveying apparatus, a jam detection method and a computer-readable, non-transitory medium which can precisely determine any occurrence of a jam by a sound which is generated by paper for various types of paper. The paper conveying apparatus includes a sound signal generator, provided with a sound detector near a conveyance path of a paper, for generating a sound signal corresponding to a sound generated by a paper during conveyance of the paper, a paper thickness setting module for setting a thickness of a paper conveyed to the conveyance path, and a sound jam detector for determining whether a jam has occurred based on a signal of a specific frequency band in the sound signal, wherein the sound jam detector determines the specific frequency band based on a thickness of the paper.

6 Claims, 17 Drawing Sheets

(56) References Cited

U.S. PATENT DOCUMENTS

| | | | | |
|---|---|---|---|---|
| 2007/0070456 | A1 | 3/2007 | Nishimura | |
| 2008/0224390 | A1 | 9/2008 | Ma et al. | |
| 2009/0022536 | A1 | 1/2009 | Takeshita et al. | |
| 2009/0190939 | A1 | 7/2009 | Satoh et al. | |
| 2010/0272460 | A1 | 10/2010 | Zona et al. | |
| 2011/0238423 | A1 * | 9/2011 | Schaertel et al. | 704/270 |
| 2012/0235929 | A1 | 9/2012 | Hongo et al. | |
| 2013/0093136 | A1 | 4/2013 | Sakharshete et al. | |
| 2013/0140757 | A1 | 6/2013 | Phinney et al. | |
| 2013/0140766 | A1 | 6/2013 | Syracuse et al. | |
| 2014/0054841 | A1 | 2/2014 | Morikawa et al. | |
| 2014/0054849 | A1 | 2/2014 | Morikawa et al. | |
| 2014/0054851 | A1 | 2/2014 | Morkiawa et al. | |
| 2014/0054852 | A1 | 2/2014 | Hongo et al. | |
| 2014/0061995 | A1 | 3/2014 | Shimazu | |
| 2014/0062008 | A1 | 3/2014 | Hongo et al. | |
| 2014/0062009 | A1 | 3/2014 | Hongo et al. | |
| 2014/0077445 | A1 | 3/2014 | Morikawa et al. | |
| 2014/0077446 | A1 | 3/2014 | Hongo et al. | |

FOREIGN PATENT DOCUMENTS

| | | |
|---|---|---|
| JP | 61-169983 | 7/1986 |
| JP | 10-267742 | 10/1998 |
| JP | 11-053602 | 2/1999 |
| JP | 2001-302021 | 10/2001 |
| JP | 2002-205449 | 7/2002 |
| JP | 2003-295707 | 10/2003 |
| JP | 2006-322947 | 11/2006 |
| JP | 2007-079263 | 3/2007 |
| JP | 2008-290288 | 12/2008 |
| JP | 2009-249046 | 10/2009 |
| JP | 2011-112665 | 6/2011 |
| JP | 2012-131579 | 7/2012 |

OTHER PUBLICATIONS

Office action mailed Jul. 9, 2013 for JP 2012-185355 including English translation, 5pp.

Office action mailed Jul. 9, 2013 for JP 2012-185358 including English translation, 4pp.

Office action mailed Jul. 9, 2013 for JP 2012-185378 including English translation, 8pp.

Office action mailed Jul. 9, 2013 for JP 2012-203466 including English translation, 7pp.

Office action mailed Jul. 9, 2013 for JP 2012-203557 including English translation, 7pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-185273, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A paper jam detection apparatus which detects a jam sound, converts it to an electrical signal, amplifies the electrical signal, and detects the jam by the specific frequency component which is included in the amplified electrical signal has been disclosed (see Japanese Laid-Open Patent Publication No. 2001-302021). By experimenting on various types of jams in advance, sounds which are generated when jams occur are detected, how strong the amplitude is for each frequency component is processed and analyzed, and the frequency component with a large amplitude strength is set as a specific frequency component.

SUMMARY

The frequency component with a strength of amplitude which becomes larger when a jam has occurred differs depending on the type of the paper, so it is desirable to precisely determine whether a jam has occurred by the sound which is generated by paper, for various types of paper.

Accordingly, it is an object of the present invention to provide a paper conveying apparatus, jam detection method that can precisely determine any occurrence of a jam by a sound which is generated by paper for various types of paper and a computer-readable, non-transitory medium storing a computer program for causing a computer to implement such a jam detection method.

According to an aspect of the apparatus, there is provided a paper conveying apparatus. The paper conveying apparatus includes a sound signal generator, provided with a sound detector near a conveyance path of a paper, for generating a sound signal corresponding to a sound generated by a paper during conveyance of the paper, a paper thickness setting module for setting a thickness of a paper conveyed to the conveyance path, and a sound jam detector for determining whether a jam has occurred based on a signal of a specific frequency band in the sound signal, wherein the sound jam detector determines the specific frequency band based on a thickness of the paper.

According to an aspect of the method, there is provide a jam detection method. The jam detection method includes acquiring a sound signal corresponding to a sound generated by a paper during conveyance of the paper, setting a thickness of paper conveyed to the conveyance path, and determining, by a computer, whether a jam has occurred based on a signal of a specific frequency band in the sound signal, and determining by the computer the specific frequency band based a thickness of the paper, in the determining step.

According to an aspect of the computer-readable, non-transitory medium storing a computer program, the computer program causes a computer to execute a process, including acquiring a sound signal corresponding to a sound generated by a paper during conveyance of the paper, setting a thickness of paper conveyed to the conveyance path, determining whether a jam has occurred based on a signal of a specific frequency band in the sound signal, and determining by the computer the specific frequency band based a thickness of the paper, in the determining step.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
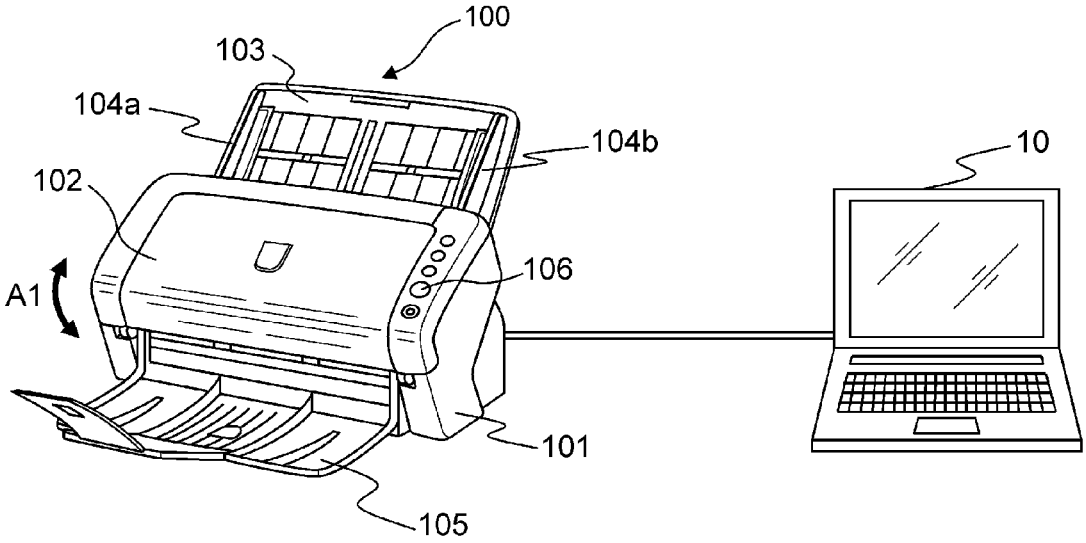
FIG. 1 is a perspective view of a paper conveying apparatus 100 and an information processing apparatus 10 according to an embodiment.

FIG. 1 is a perspective view which shows a paper conveying apparatus 100 which are configured as an image scanner, and an information processing apparatus 10, according to an embodiment.

The paper conveying apparatus 100 includes a lower housing 101, an upper housing 102, a paper tray 103, an ejection tray 105, an operation button 106, etc., and is connected to an information processing apparatus (for example, personal computer, portable data terminal, etc.)

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
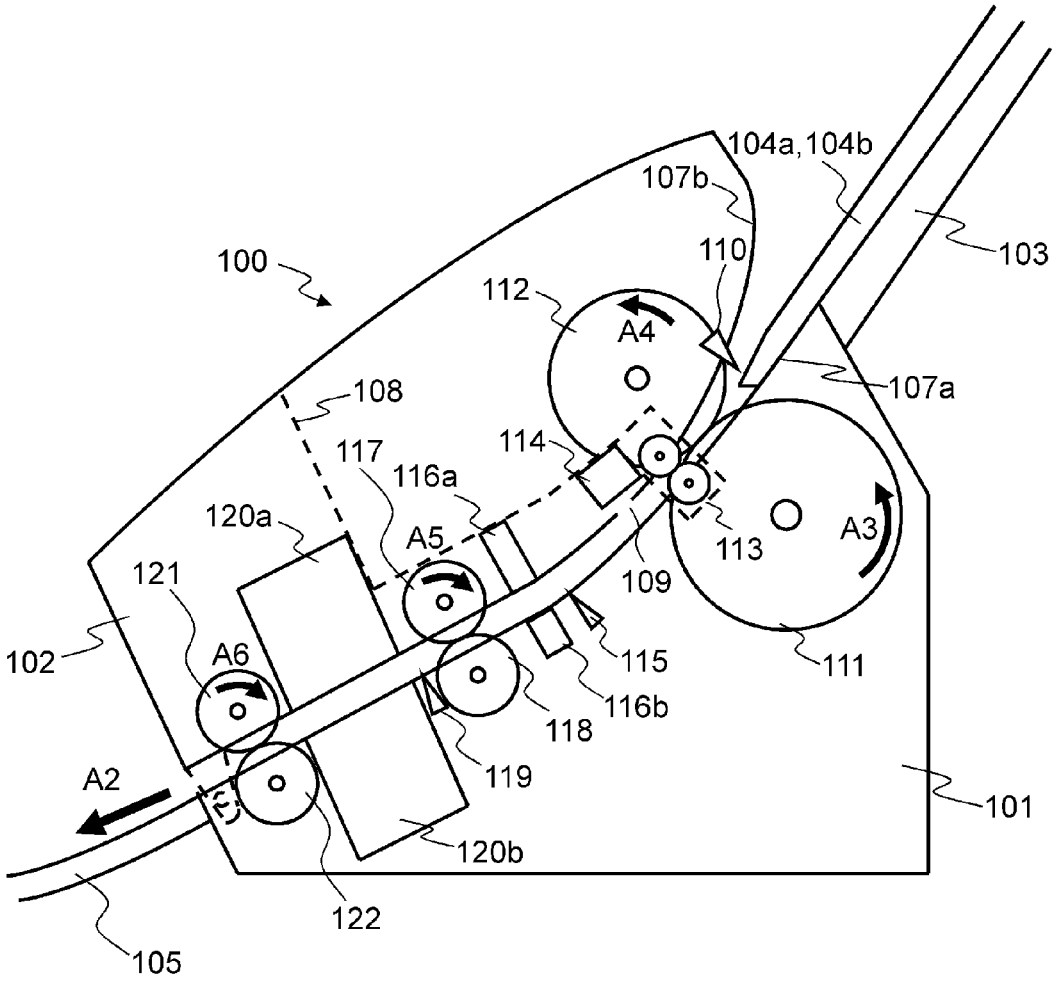
FIG. 2 is an example of a view for explaining a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, a paper feed roller 111, a retard roller 112, a paper thickness detector 113, a microphone 114, a second paper detector 115, an ultrasonic transmitter 116*a*, an ultrasonic receiver 116*b*, a first conveyor roller 117, a first driven roller 118, a third paper detector 119, a first image capture unit 120*a*, a second image capture unit 120*b*, a second conveyor roller 121, a second driven roller 122, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 114 is an example of an sound detector, is provided near a conveyance path of a paper, and detects the sound generated by a paper during conveyance of the paper, and generate and outputs an analog signal corresponding to the detected sound. The microphone 114 is arranged at the downstream side of the paper feed roller 111 and the retard roller 112 while fastened to the frame 108 at the inside of the upper housing 102. A hole 109 is provided in the upper guide 107*b* facing the microphone 114, so that the sound generated by the paper during conveyance of the paper can be more accurately detected by the microphone 114.

The second paper detector 115 has a contact detection sensor which is arranged at a downstream side of the paper feed roller 111 and the retard roller 112 and at an upstream side of the first conveyor roller 117 and first driven roller 118 and detects if there is a paper present at that position. The second paper detector 115 generates and outputs a second paper detection signal which changes in signal value between a state at which there is a paper at that position and a state where there is no paper there.

The ultrasonic transmitter 116*a* and the ultrasonic receiver 116*b* are arranged near the conveyance path of the paper so as to face each other across the conveyance path. The ultrasonic transmitter 116*a* transmits an ultrasonic wave. On the other hand, the ultrasonic receiver 116*b* detects an ultrasonic wave which is transmitted by the ultrasonic transmitter 116*a* and passes through the paper or papers, and generates and outputs an ultrasonic signal comprised of an electrical signal corresponding to the detected ultrasonic wave. Below, the ultrasonic transmitter 116*a* and the ultrasonic receiver 116*b* will sometimes be referred to altogether as the "ultrasonic sensor 116".

The third paper detector 119 has a contact detection sensor which is arranged at a downstream side of the first conveyor roller 117 and the first driven roller 118 and an upstream side of the first image capture unit 120*a* and the second image capture unit 120*b* and detects if there is a paper at that position. The third paper detector 119 generates and outputs a third paper detection signal which changes in signal value between a state where there is a paper at that position and a state where there is no such paper there.

The first image capture unit 120*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 120*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 120*a* and the second image capture unit 120*b* and read only one surface of the paper. Further, instead of a CIS, it is also possible to utilize an image capturing sensor of a reduced magnification optical system type using CCD's (charge coupled devices). Below, the first image capture unit 120*a* and the second image capture unit 120*b* will sometimes be referred to overall as the "image capture units 120".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 117 and the first driven roller 118 while being guided by the lower guide 107*a* and the upper guide 107*b*. The paper is sent between the first image capture unit 120*a* and the second image capture unit 120*b* by the first conveyor roller 117 rotating in the direction of the arrow mark A5 of FIG. 2. The paper which is read by the image capture unit 120 is ejected onto the ejection tray 105 by the second conveyor roller 121 rotating in the direction of the arrow mark A6 of the FIG. 2.

Figure 3:
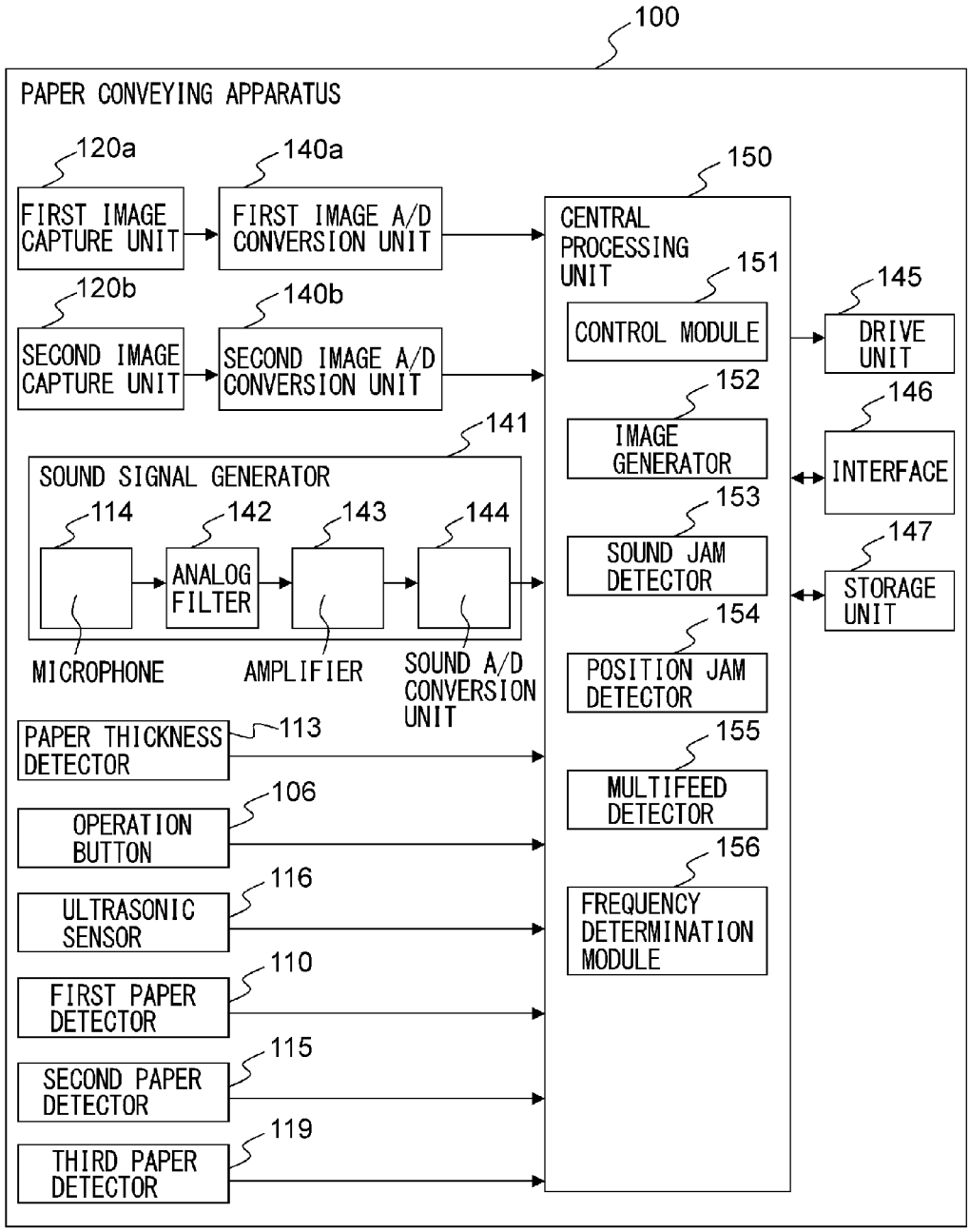
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 120*a* from an analog to digital format to generate digital image data which it then outputs to the central processing unit 150. Similarly, the second image A/D conversion unit 140*b* converts the analog image signal which is output from the second image capture unit 120*b* from an analog to digital format to generate digital image data which it then outputs to the central processing unit 150. Below, these digital image data will be referred to as the "read image".

The sound signal generator 141 includes a microphone 114, an analog filter 142, an amplifier 143, a sound A/D conversion unit 144, etc., and generates a sound signal. The analog filter 142 is provided with a plurality of bandpass filters which pass signals of predetermined respectively different frequency bands. The analog filter 142 applies a bandpass filter which is set by the central processing unit 150 to the analog signal which is output from the microphone 114 and outputs it to the amplifier 143. Note that, the analog filter 142 may be provided with a single bandpass filter and may be configured so that a frequency band which the bandpass filter passes is set by the central processing unit 150.

The amplifier 143 amplifies the signal which is output from the analog filter 142 and outputs it to the sound A/D conversion unit 144. The sound A/D conversion unit 144 converts the analog signal which is output from the amplifier 143 to a digital signal and outputs it to the central processing unit 150. The signal which is output by the sound signal generator 141 will be referred to as a "sound signal".

Note that, the sound signal generator 141 is not limited to this. The sound signal generator 141 may include only the microphone 114, while the analog filter 142, the amplifier 143, and the sound A/D conversion unit 144 may be provided outside of the sound signal generator 141. Further, the sound signal generator 141 may include only the microphone 114 and analog filter 142 or only the microphone 114, the analog filter 142, and the amplifier 143.

The drive unit 145 includes one or more motors and uses control signals from the central processing unit 150 to rotate the paper feed roller 111, the retard roller 112, the first conveyor roller 117, and the second conveyor roller 121 and operate to convey a paper.

The interface 146 has, for example, a USB or other serial bus-based interface circuit and electrically connects with the information processing apparatus 10 to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read image.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, paper thickness detector 113, microphone 114, second paper detector 115, ultrasonic sensor 116, third paper detector 119, first image capture unit 120*a*, second image capture unit 120*b*, first image A/D conversion unit 140*a*, second image A/D conversion unit 140*b*, sound signal generator 141, drive unit 145, interface 146, and storage unit 147 and controls these units.

The central processing unit 150 control a drive operation of the drive unit 145, control a paper read operation of the image capture unit 120, etc., to acquire a read image. Further, the central processing unit 150 has a control module 151, an image generator 152, a sound jam detector 153, a position jam detector 154, a multifeed detector 155, a frequency determination module 156, etc. These units are functional modules which are realized by software which operate on a processor. Note that, these units may be comprised of respectively independent integrated circuits, a microprocessor, firmware, etc.

Figure 4:
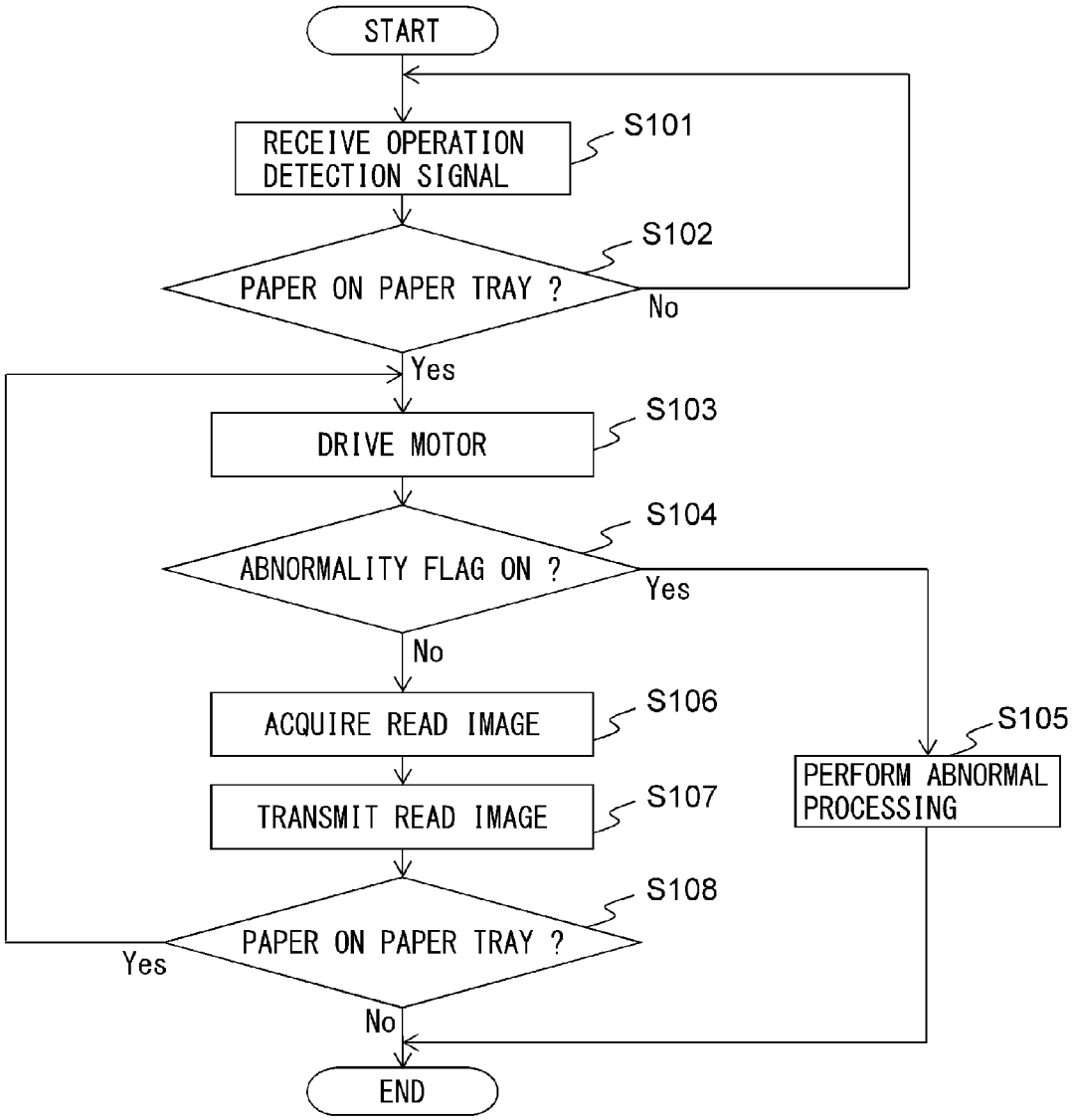
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 117, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 120*a* and the second image capture unit 120*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determine whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
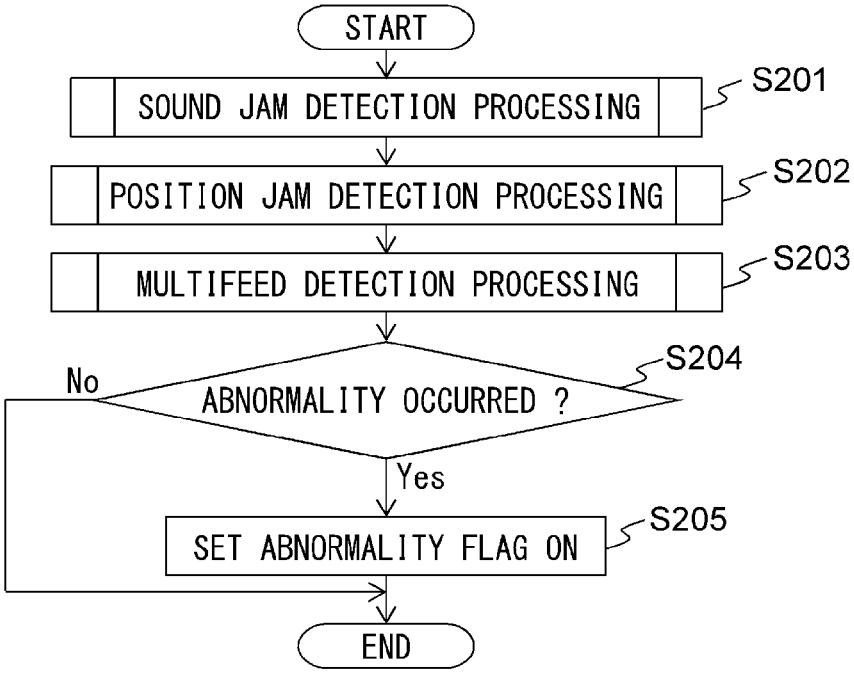
FIG. 5 is a flow chart which shows an example of an abnormality detection of the paper conveyance.

FIG. 5 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the sound signal which was acquired from the sound signal generator 141. Below, sometimes a jam which is determined to exist by the sound jam detector 153 based on a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 115 and the third paper detection signal which is acquired from the third paper detector 119. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 116. Details of the multifeed detection processing will be explained later.

Next, the control module 151 determines whether an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6:
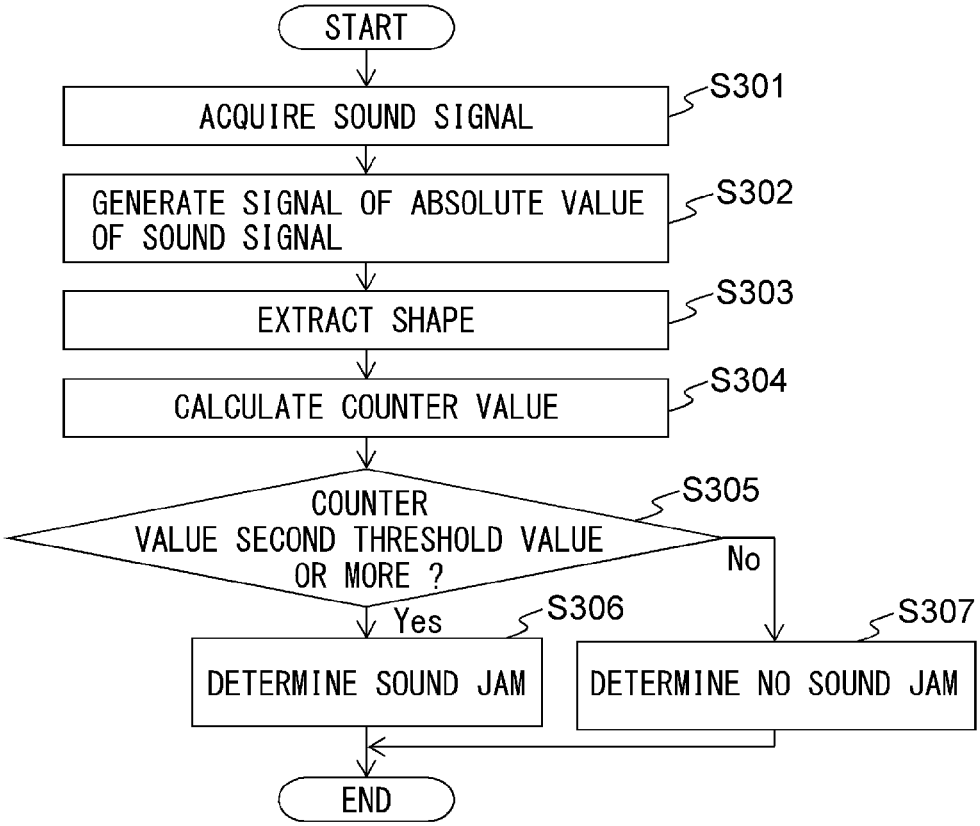
FIG. 6 is a flow chart which shows an example of operation of sound jam detection processing.

FIG. 6 is a flow chart which shows an example of operation of a sound jam detection processing.

The flow of operation which is shown in FIG. 6 is executed at step S201 of the flow chart which is shown in FIG. 5.

First, the sound jam detector 153 acquires a sound signal from the sound signal generator 141 (step S301).

Figure 7A:
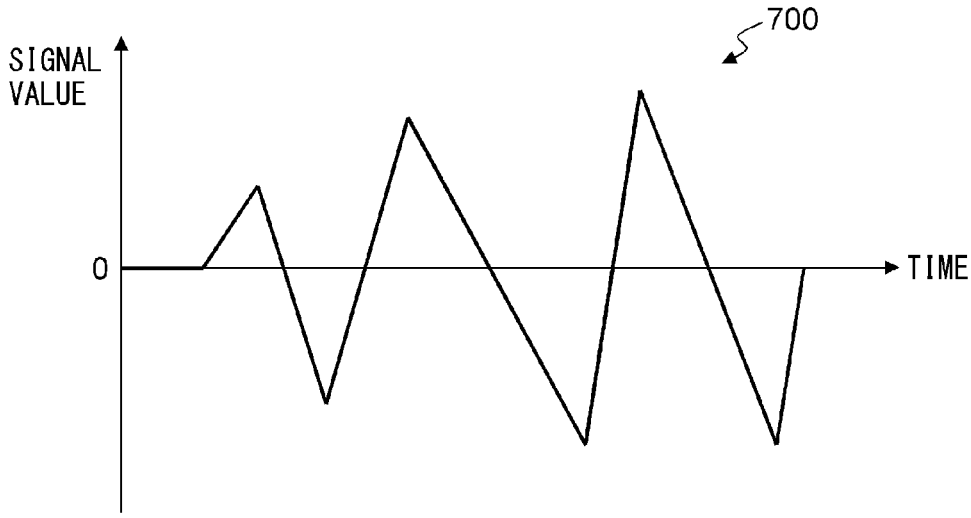
FIG. 7A is a graph which shows an example of a sound signal.

FIG. 7A is a graph which shows an example of a sound signal. The graph 700 which is shown in FIG. 7A shows a sound signal which is acquired from the sound signal generator 141. The abscissa of graph 700 shows the time, while the ordinate shows the signal value of the sound signal.

Next, the sound jam detector 153 generates a signal of the absolute value of the sound signal received from the sound signal generator 141 (step S302).

Figure 7B:
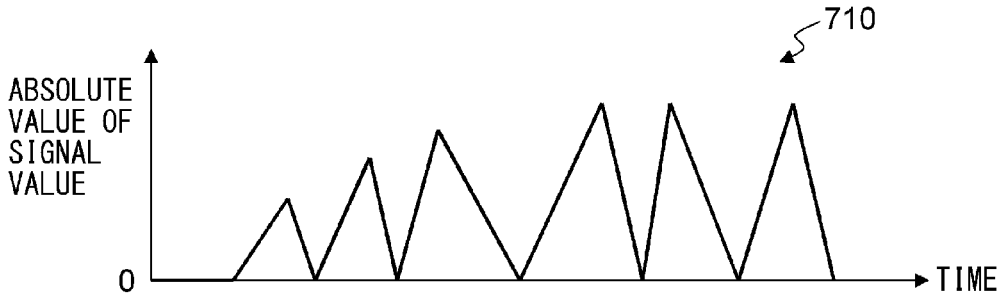
FIG. 7B is a graph which shows an example of a signal of an absolute value of a sound signal.

FIG. 7B is a graph which shows an example of the signal of the absolute value of the sound signal. The graph 710 which is shown in FIG. 7B shows the signal of the absolute value of the sound signal of the graph 700. The abscissa of graph 710 shows the time, while the ordinate shows the signal of the absolute value of the sound signal.

Next, the sound jam detector 153 extracts a shape of a signal of the absolute value of the sound signal (step S303). The sound jam detector 153 extracts the envelope as the shape of the signal of the absolute value of the sound signal.

Figure 7C:
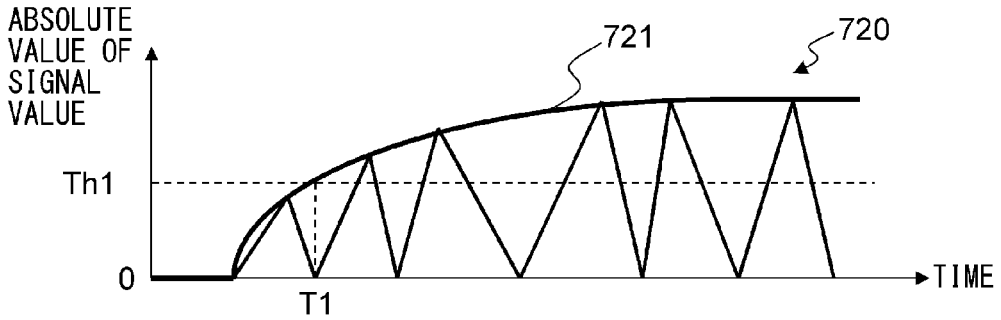
FIG. 7C is a graph which shows an example of the shape of a signal of an absolute value of the sound signal.

FIG. 7C is a graph which shows an example of the shape of a signal of the absolute value of the sound signal. The graph 720 which is shown in FIG. 7C shows the envelope 721 of the signal of the absolute value of the sound signal of the graph 710. The abscissa of the graph 720 shows the time, while the ordinate shows the absolute value of the signal value of the sound signal.

Next, the sound jam detector 153 calculates a counter value which it increases when the shape of the signal of the absolute value of the sound signal is a first threshold value Th1 or more and which it decreases when it is less than the first threshold value Th1 (step S304). The sound jam detector 153 determines whether the value of the envelope 721 is the first threshold value Th1 or more at each predetermined time interval (for example, sampling intervals of sound signal), increments the counter value when the value of the envelope 721 is the first threshold value Th1 or more, and decrements the counter value when it is less than the first threshold value Th1.

Figure 7D:
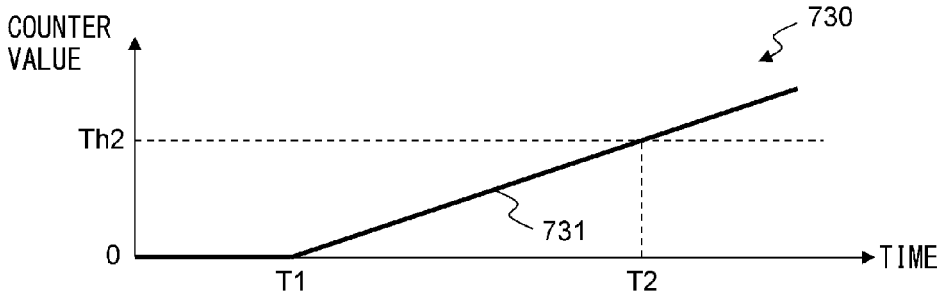
FIG. 7D is a graph which shows an example of a counter value.

FIG. 7D is a graph which shows an example of the counter value which is calculated for the shape of the signal of the absolute value of the sound signal. The graph 730 which is shown in FIG. 7D expresses the counter value which is calculated for the envelope 721 of the graph 720. The abscissa of the graph 720 shows the time, while the ordinate shows the counter value.

Next, the sound jam detector 153 determines whether the counter value is a second threshold value Th2 or more (step S305). The sound jam detector 153 determines that a sound jam has occurred if the counter value is the second threshold value Th2 or more (step S306), determines that a sound jam has not occurred if the counter value is less than the second threshold value Th2 (step S307), and then ends the series of steps.

In FIG. 7C, the envelope 721 is the first threshold value Th1 or more at the time T1 and thereafter does not become less than the first threshold value Th1. For this reason, as shown in FIG. 7D, the counter value increases from the time T1 and becomes the second threshold value Th2 or more at the time T2, then the sound jam detector 153 determines that a sound jam has occurred.

Note that, at step S303, instead of acquiring the envelope as the shape of the signal of the absolute value of the sound signal, the sound jam detector 153 may acquire a signal of the peak hold for the signal of the absolute value of the sound signal (below, referred to as the "peak hold signal"). For example, the central processing unit 150 holds the local maximum value of the signal of the absolute value of the sound signal for exactly a predetermined hold period and then attenuates it by a constant attenuation rate to acquire the peak hold signal.

Figure 8A:
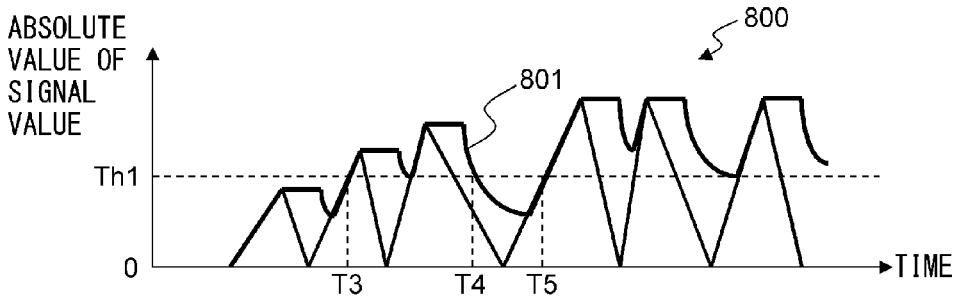
FIG. 8A is a graph which shows an example of a peak hold signal which is found from a sound signal.
Figure 8B:
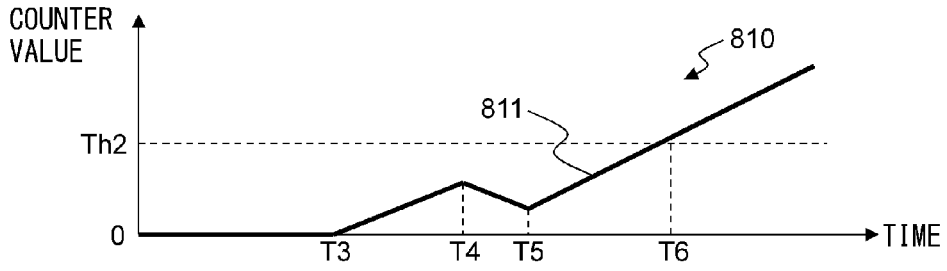
FIG. 8B is a graph which shows an example of a counter value.

FIG. 8A and FIG. 8B are views for explaining the processing for acquiring the peak hold signal from the sound signal and determining whether a sound jam has occurred.

The graph 800 which is shown in FIG. 8A expresses the peak hold signal 801 for the signal of the absolute value of the sound signal of the graph 710. The abscissa of the graph 800 shows the time, while the ordinate shows the absolute value of the signal value of the sound signal.

The graph 810 which is shown in FIG. 8B shows the counter value which was calculated for the peak hold signal 801 of the graph 800. The abscissa of the graph 810 shows the time, while the ordinate shows the counter value. The peak hold signal 801 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 8B, the counter value increases from the time T3, decreases from the time T4, again increases from the time T5, and becomes the second threshold value Th2 or more at the time T6, so it is determined that a sound jam has occurred.

Figure 9:
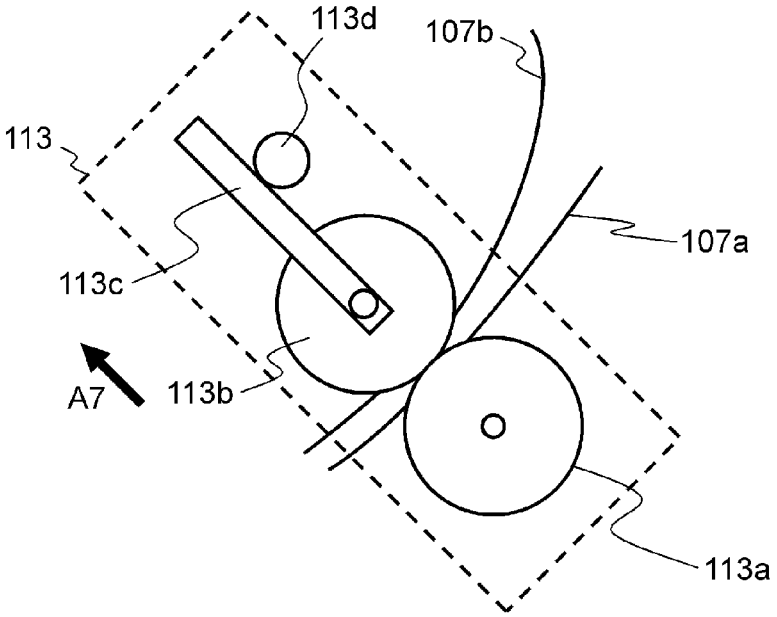
FIG. 9 is a view for explaining a paper thickness detector 113.

FIG. 9 is a view for explaining the paper thickness detector 113.

The paper thickness detector 113 is an example of a paper thickness setting module, and is a member for setting the thickness of the paper conveyed to the conveyance path. It comprises a lower roller 113*a*, upper roller 113*b*, support member 113*c*, rotary encoder 113*d*, etc., and detects the thickness of the paper which is conveyed on the conveyance path.

The lower roller 113*a* is fixed in place, while the upper roller 113*b* is pushed up by the conveyed paper and is arranged to be able to move in the direction of the arrow mark A7. The upper roller 113*b* is connected to the support member 113*c*. It is configured so that if the support member 113*c* moves in accordance with movement of the upper roller 113*b*, the rotary encoder 113*d* rotates. The paper thickness detector 113 outputs the information which shows the rotational angle of the rotary encoder 113*d* as the paper thickness signal for finding the thickness of the paper to the central processing unit 150. The central processing unit 150 can find the distance over which the upper roller 113*b* moves in the upward direction, that is, the thickness of the conveyed paper, from the rotational angle of the rotary encoder 113*d*.

The paper thickness detector 113 which is shown in FIG. 9 is one example. The invention is not limited to this. For example, the paper thickness detector 113 may comprise an optical sensor. The optical sensor comprises an LED (light emitting diode) or other light source which emits light to the conveyed paper and a light receiving element which receives light which is emitted from the light source and is reflected at the paper and measures the distance to the paper based on the light which was received by the light emitting element. The paper thickness detector 113 can arrange two optical sensors straddling the paper conveyance path and thereby find the thickness of paper from the difference between the distance between the two optical sensors and the distances to the paper which the optical sensors measure.

Figure 10:
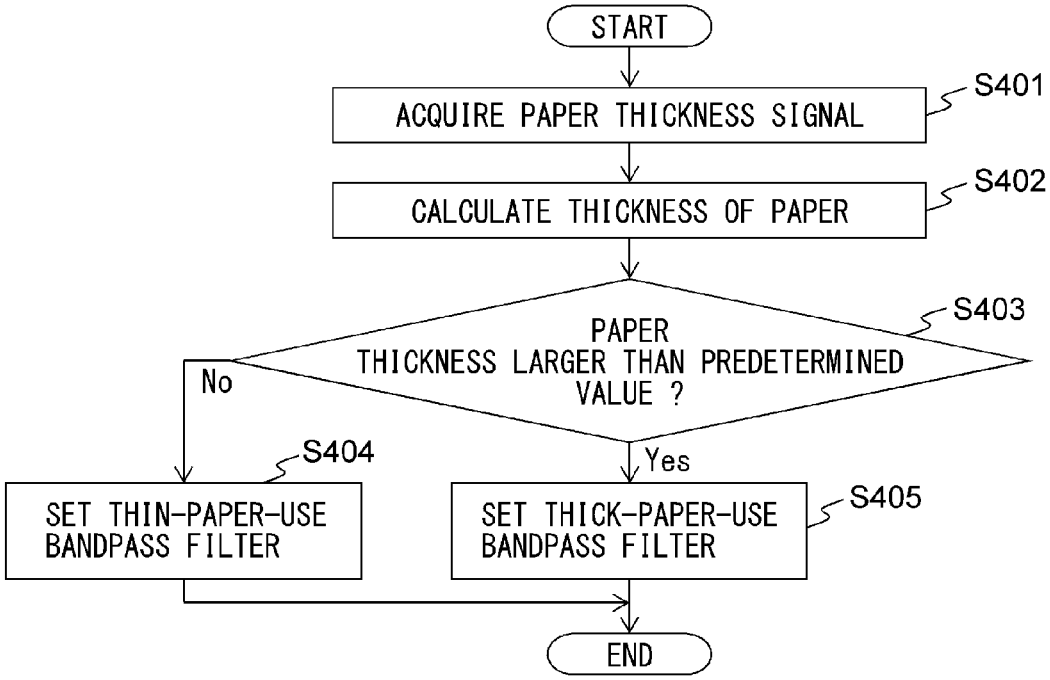
FIG. 10 is a flow chart which shows an example of operation of filter setting processing.

FIG. 10 is a flow chart which shows an example of the operation of processing for setting the analog filter 142.

The flow of operation which is explained below is performed based on a program which is stored in advance in the storage unit 147 mainly by the central processing unit 150 in cooperation with the elements of the paper conveying apparatus 100. This flow chart is followed at the timing when the central processing unit 150 drives the drive unit 145 to rotate the paper feed roller 111 and the retard roller 112 and the front end of the paper passes the paper thickness detector 113. Further, the sound jam detector 153 may double as the frequency determination module 156.

First, the frequency determination module 156 acquires the paper thickness signal from the paper thickness detector 113 (step S401) and calculates the thickness of the paper from the rotational angle of the rotary encoder 113*d* which is shown in the acquired paper thickness signal (step S402).

Next, the frequency determination module 156 determines whether the thickness of the paper is larger than a predetermined value (step S403). The predetermined value can be made the standard thickness 0.1 mm (ream weight 70 kg) of, for example, PPC (plain paper copier) paper, but another value may also be used. Below, sometimes paper with a thickness of a predetermined value or less will be referred to as "thin paper" and paper larger than the predetermined value will be referred to as "thick paper".

When the thickness of the paper is a predetermined value or less, that is, when the paper is thin paper, the frequency determination module 156 sets the bandpass filter of the analog filter 142 to a thin-paper-use bandpass filter which passes only a signal of a predetermined high frequency band (step S404) and ends the series of steps. Note that, the pass band of the thin-paper-use bandpass filter may be made 2 kHz to 5 kHz, but how the pass band is determined will be explained later.

On the other hand, when the thickness of the paper is larger than the predetermined value, that is, the paper is thick paper, the frequency determination module 156 sets the bandpass filter of the analog filter 142 to a thick-paper-use bandpass filter which passes only a signal of a predetermined low frequency band (step S405) and ends the series of steps. Note that, the pass band of the thick-paper-use bandpass filter may be made 200 Hz to 2 kHz, but how the pass band is determined will be explained later.

Note that, the bandpass filters which the analog filter 142 are provided with are not limited to two filters and may be three or more filters as well. In this case, the frequency determination module 156 decides the pass band which is passed by the analog filter 142 based on the thickness of the conveyed paper and sets the bandpass filter of the analog filter 142 to the bandpass filter corresponding to that pass band. The pass band is decided to become lower the thicker the conveyed paper and to become higher the thinner the paper. When the analog filter 142 is provided with three bandpass filters, the pass bands of the bandpass filters can be set to, for example, 200 Hz to 2 kHz (thick paper: 0.16 mm (ream weight: 110 kg) or more), 500 Hz to 3 kHz (medium paper: over 0.04 mm (ream weight: 26 kg) and less than 0.16 mm), and 2 kHz to 5 kHz (thin paper: 0.04 mm or less). Note that, the bands of the bandpass filters may be set overlapping each other as explained above.

As shown in FIG. 2, the microphone 114 is provided near the paper feed roller 111 and retard roller 112 so as to be able to detect sound which is generated at the paper feed roller 111 and retard roller 112 which separate the paper. On the other hand, as explained above, the frequency determination module 156 sets the bandpass filter of the analog filter 142 based on the thickness of the conveyed paper to the paper thickness detector 113. For this reason, the paper thickness detector 113 is preferably provided near the paper feed roller 111 and retard roller 112 so as to be able to detect the thickness of the conveyed paper at as early a timing as possible. In particular, preferably the paper thickness detector 113 outputs a paper thickness signal for the paper before the microphone 114 outputs a sound signal regarding the conveyed paper and preferably is provided at the upstream side of the microphone 114.

Figure 11A:
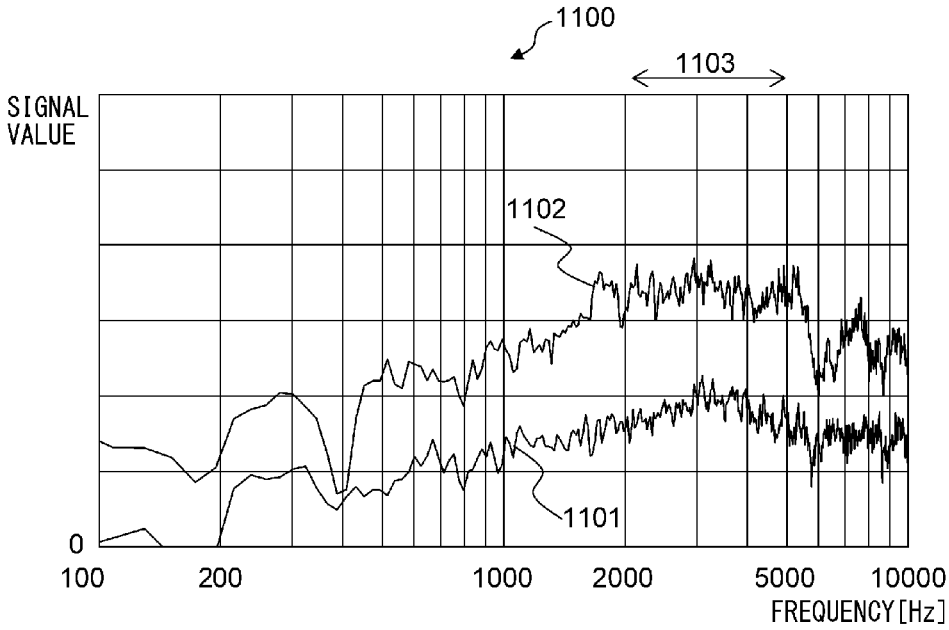
FIG. 11A is a view for explaining properties of a sound signal when a jam occurs.
Figure 11B:
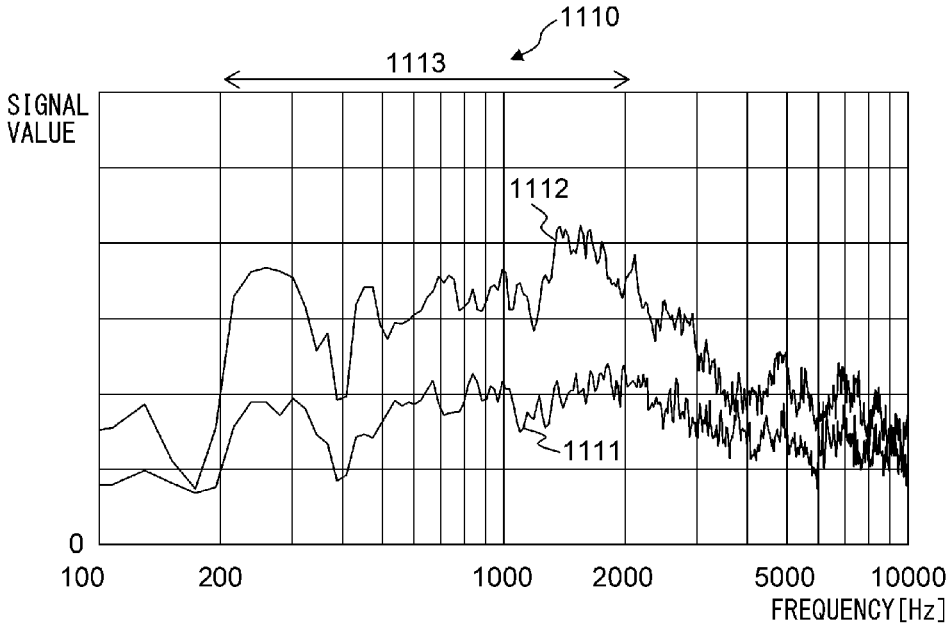
FIG. 11B is a view for explaining properties of a sound signal when a jam occurs.

FIG. 11A and FIG. 11B are views for explaining the properties of sound signals when a jam has occurred due to different paper for a plurality of paper of different thicknesses.

In FIG. 11A, the abscissa shows the frequency, while the ordinate shows the strength of the frequency signal acquired by converting the sound signal in frequency. In the graph 1100 of FIG. 11A, the solid line 1101 shows the frequency signal when a jam has occurred due to paper of a thickness of 0.03 mm (ream weight: 22 kg) as one example of thin paper, while the solid line 1102 shows the frequency signal when a jam has occurred due to paper of a thickness of 0.04 mm (ream weight: 26 kg) as one example of thin paper. When a jam has occurred due to thin papers, the signal strength at the frequency band 1103 of 2 kHz to 5 kHz tends to become larger than the signal strength at other frequency bands.

In FIG. 11B, the abscissa shows the frequency, while the ordinate shows the strength of the frequency signal. In the graph 1110 of FIG. 11B, the solid line 1111 shows the frequency signal when a jam has occurred due to paper of a thickness of 0.16 mm (ream weight: 110 kg) as one example of thick paper, while the solid line 1112 shows the frequency signal when a jam has occurred due to paper of a thickness of 0.19 mm (ream weight: 130 kg) as one example of thick paper. When a jam has occurred due to thick papers, the signal strength at the frequency band 1113 of 200 Hz to 2 kHz tends to become larger than the signal strength at other frequency bands.

In this way, when a jam has occurred due to thin paper, the frequency band at which the signal strength becomes larger becomes higher, while when a jam has occurred due to thick paper, the frequency band at which the signal strength becomes larger tends to become lower. On the other hand, the sound which the microphone 114 detects includes, in addition to the sound generated by a jam, the sound of conveyance of paper, the drive sound of the motor, sound generated at the outside of the housing, and other noise of various frequency bands.

Therefore, the paper conveying apparatus 100 can generate a sound signal with a small ratio of noise to the sound which is generated by a jam by cutting the components of frequency bands other than the frequency band where the strength of the frequency signal becomes larger when a jam has occurred due to different paper in the sound signal which the microphone 114 outputs. Further, the paper conveying apparatus 100 can eliminate the effects of noise by setting the above-mentioned first threshold value Th1 between the magnitude of the sound which is generated due to a jam and the magnitude of the noise. For this reason, the frequency determination module 156 determines the frequency band of the sound signal to be passed by the analog filter 142 as explained above based on the thickness of the conveyed paper.

Figure 12:
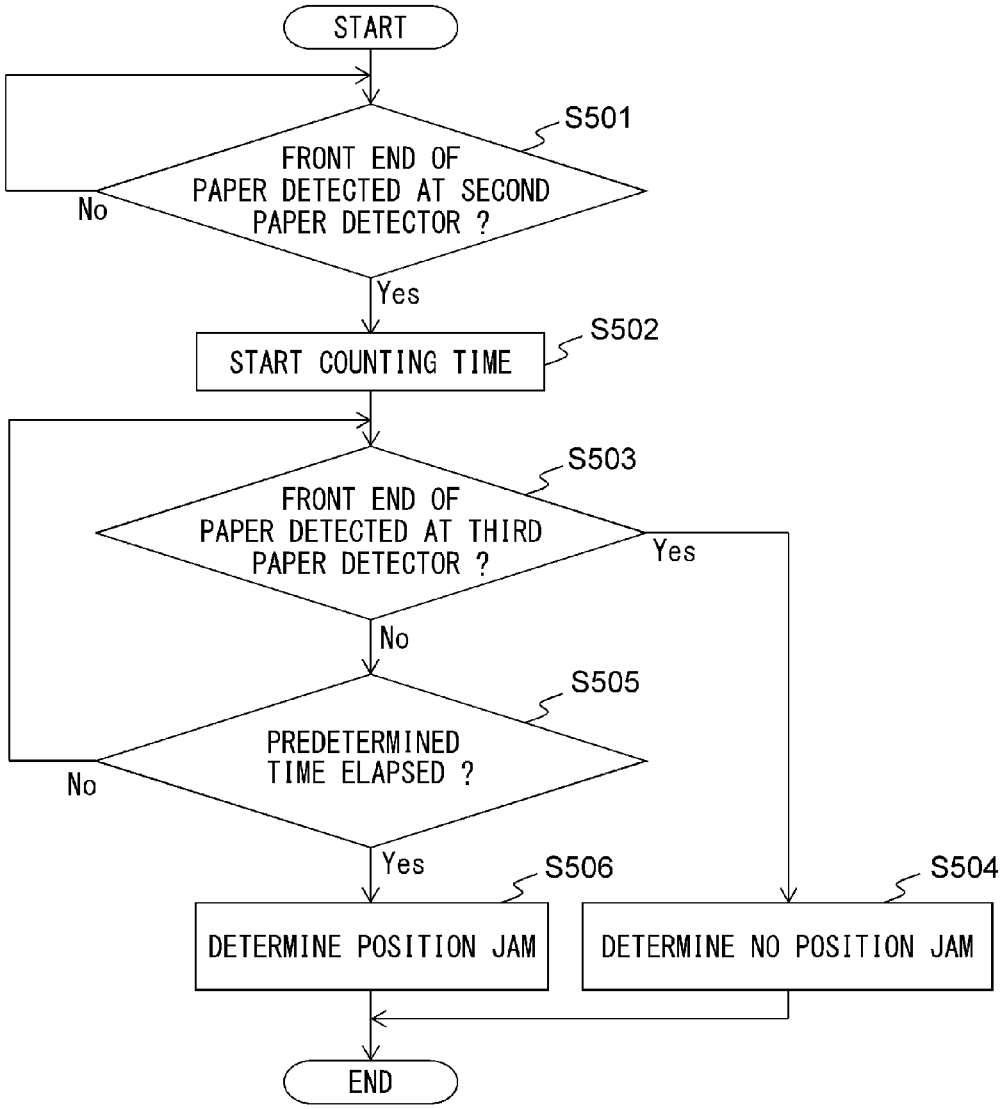
FIG. 12 is a flow chart which shows an example of operation of position jam detection processing.

FIG. 12 is a flow chart which shows an example of operation of a position jam detection processing.

The flow of operation which is shown in FIG. 12 is executed at step S202 of the flow chart which is shown in FIG. 5.

First, the position jam detector 154 stands by until the front end of the paper is detected by the second paper detector 115 (step S501). The position jam detector 154 determines that the front end of the paper is detected at the position of the second paper detector 115, that is, downstream of the paper feed roller 111 and retard roller 112 and upstream of the first conveyor roller 117 and first driven roller 118, when the value of the second paper detection signal from the second paper detector 115 changes from a value which shows the state where there is no paper to a value which shows the state where there is one.

Next, when the second paper detector 115 detects the front end of a paper, the position jam detector 154 starts counting time (step S502).

Next, the position jam detector 154 determines whether the third paper detector 119 has detected the front end of the paper (step S503). The position jam detector 154 determines that the front end of the paper is detected at the position of the third paper detector 119, that is, downstream of the first conveyor roller 117 and first driven roller 118 and upstream of the image capture unit 120, when the value of the third paper detection signal from the third paper detector 119 changes from a value which shows the state where there is no paper to a value which shows the state where there is one.

When the third paper detector 119 detects the front end of a paper, the position jam detector 154 determines that no position jam has occurred (step S504) and ends the series of steps.

On the other hand, if the third paper detector 119 detects the front end of the paper, the position jam detector 154 determines whether a predetermined time (for example, 1 second) has elapsed from the start of counting time (step S505). If a predetermined time has not elapsed, the position jam detector 154 returns to the processing of step S503 and again determines whether the third paper detector 119 has detected the front end of the paper. On the other hand, when a predetermined time has elapsed, the position jam detector 154 determines that position jam has occurred (step S506) and ends the series of steps. Note that, when position jam detection processing is not required in the paper conveying apparatus 100, this may be omitted.

Note that, when the central processing unit 150 detects that the front end of a paper is downstream of the first conveyor roller 117 and the first driven roller 118 by the third paper detection signal from the third paper detector 119, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 115, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 119 does not detect the front end of a paper within a predetermined time.

Figure 13:
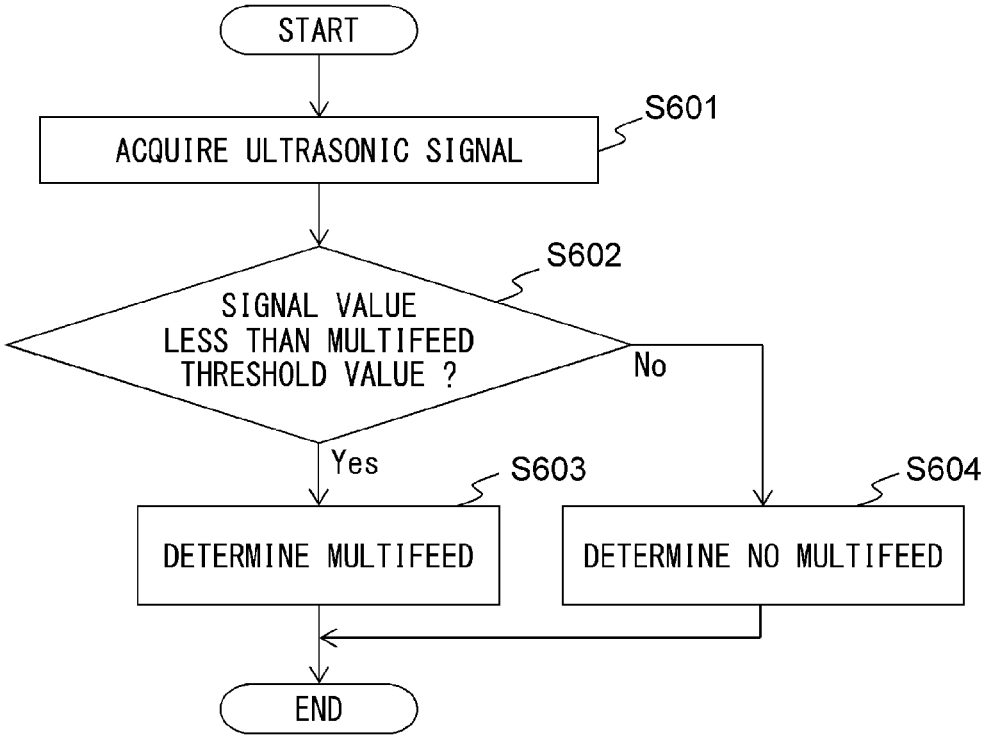
FIG. 13 is a flow chart which shows an example of operation of multifeed detection processing.

FIG. 13 is a flow chart which shows an example of operation of multifeed detection processing.

The flow of operation which is shown in FIG. 13 is executed at step S203 of the flow chart which is shown in FIG. 5.

First, the multifeed detector 155 acquires an ultrasonic signal from the ultrasonic sensor 116 (step S601).

Next, the multifeed detector 155 determines whether the signal value of the acquired ultrasonic signal is less than the multifeed detection threshold value (step S602).

Figure 14:
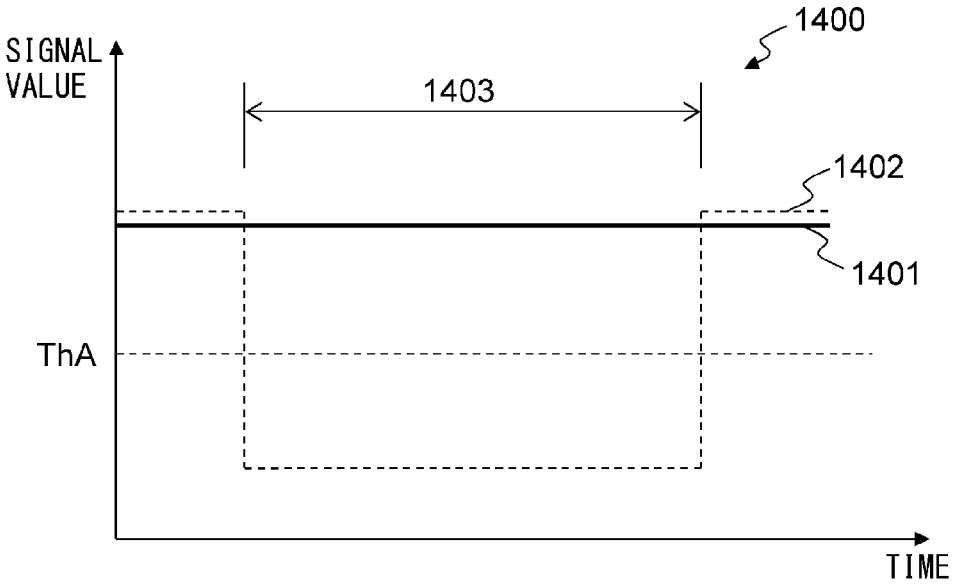
FIG. 14 is a view for explaining properties of an ultrasonic signal.

FIG. 14 is a view for explaining properties of an ultrasonic signal.

In the graph 1400 of FIG. 14, the solid line 1401 shows the characteristic of the ultrasonic signal in the case where a single paper is conveyed, while the broken line 1402 shows the characteristic of the ultrasonic signal in the case where multifeed of papers has occurred. The abscissa of the graph 1400 shows the time, while the ordinate shows the signal value of the ultrasonic signal. Due to the occurrence of multifeed, the signal value of the ultrasonic signal of the broken line 1402 falls in the section 1403. For this reason, it is possible to determine whether multifeed of papers has occurred by whether the signal value of the ultrasonic signal is less than the multifeed detection threshold value ThA.

The multifeed detector 155 determines that multifeed of the papers has occurred when the signal value of the ultrasonic signal is less than the multifeed detection threshold value (step S603), determines that multifeed of the papers has not occurred when the signal value of the ultrasonic signal is the multifeed detection threshold value or more (step S604), and ends the series of steps. Note that, when multifeed detection processing is not necessary in the paper conveying apparatus, this may be omitted.

As explained above in detail, the paper conveying apparatus 100 is designed to operate in accordance with the flow charts of FIG. 4, FIG. 5, FIG. 6, and FIG. 10 so as to generate a sound signal with a small ratio of noise to the sound which is generated due to a jam based on the thickness of the conveyed paper. Due to this, the paper conveying apparatus 100 can eliminate the effects of noise for paper of various thicknesses and can precisely determine any occurrence of a jam by the sound which paper generates.

Figure 15:
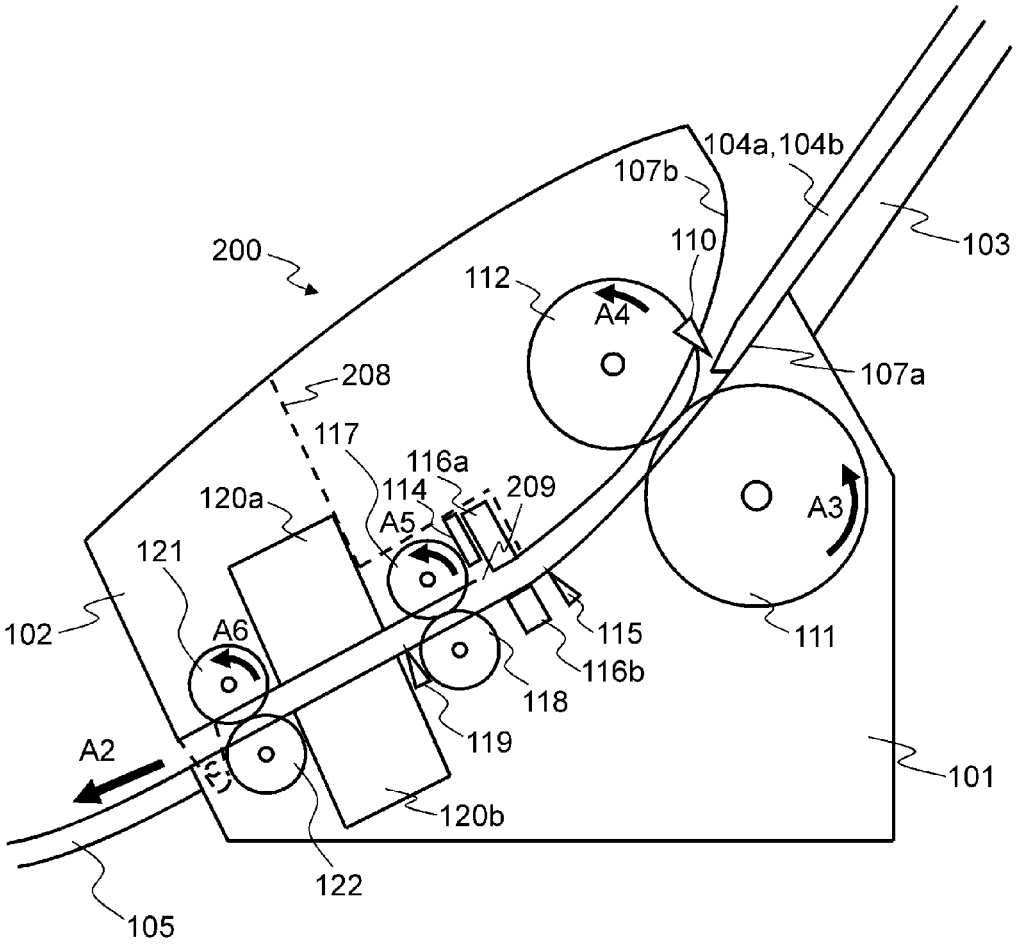
FIG. 15 is a view for explaining a conveyance route at an inside of a paper conveying apparatus 200 according to another embodiment.

FIG. 15 is a view for explaining a conveyance route at the inside of a paper conveying apparatus 200 according to another embodiment.

The paper conveying apparatus 200 which is shown in FIG. 15 utilizes an ultrasonic sensor 116 instead of the paper thickness detector 113 of the paper conveying apparatus 100 which is shown in FIG. 2, and the position of the microphone 114 is shifted downstream of the ultrasonic sensor 116. This paper conveying apparatus 200 utilizes the ultrasonic signal which is output from the ultrasonic sensor 116 so as to acquire the thickness of paper. That is, in this paper conveying apparatus 200, the ultrasonic sensor 116 outputs an ultrasonic signal for determining any multifeed and functions as a paper thickness detector to detect the thickness of paper.

The thicker the conveyed paper, the more the ultrasonic wave which passes through the paper is attenuated and the more the ultrasonic signal which the ultrasonic sensor 116 outputs is reduced. For this reason, the frequency determination module 156 can determine whether the conveyed paper is thick paper or thin paper based on whether the signal value of the ultrasonic signal is less than the thickness detection threshold value ThB.

As explained above, the paper thickness detector is preferably provided at the upstream side of the microphone, so the microphone 114 is arranged fastened to the frame 208 at the inside of the upper housing 102 at the downstream side of the ultrasonic sensor 116. Further, a position of the upper guide 107*b* facing the microphone 114 is provided with a hole 209 for the microphone 114 to detect sound.

As explained above in detail, the paper conveying apparatus 200 can use the ultrasonic sensor 116 to detect the thickness of the conveyed paper, so can eliminate the effects of the noise for paper of various thicknesses of paper and can precisely determine any occurrence of a jam by the sound which the paper generates. Further, by using the ultrasonic sensor 116 as a paper thickness detector, it becomes possible to also reduce the cost of the apparatus.

Figure 16:
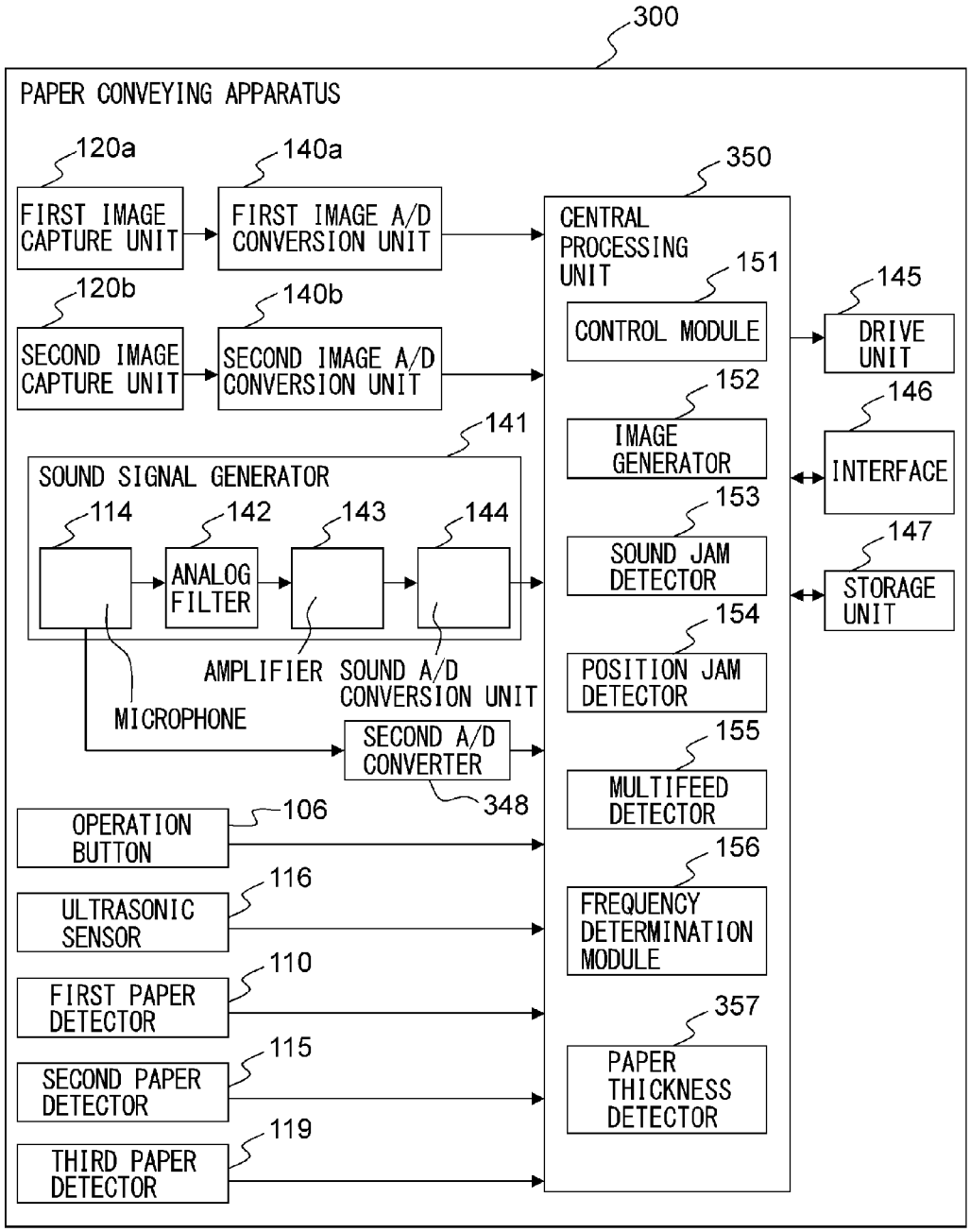
FIG. 16 is a block diagram which shows a schematic configuration of a paper conveying apparatus 300 according to still another embodiment.

FIG. 16 is a block diagram which shows the schematic configuration of a paper conveying apparatus 300 according to still another embodiment.

Instead of the paper thickness detector 113 of the paper conveying apparatus 100 which is shown in FIG. 3, the paper conveying apparatus 300 which is shown in FIG. 16 mounts a paper thickness detector 357 as a functional module of the central processing unit 350 and, furthermore, has a second sound A/D conversion unit 348.

The second sound A/D conversion unit 348 converts the analog signal which is output from the microphone 114 to a digital signal and outputs it to the central processing unit 350. Below, the digital signal which the second sound A/D conversion unit 348 outputs will be referred to as the "sound signal for frequency analysis use".

Figure 17:
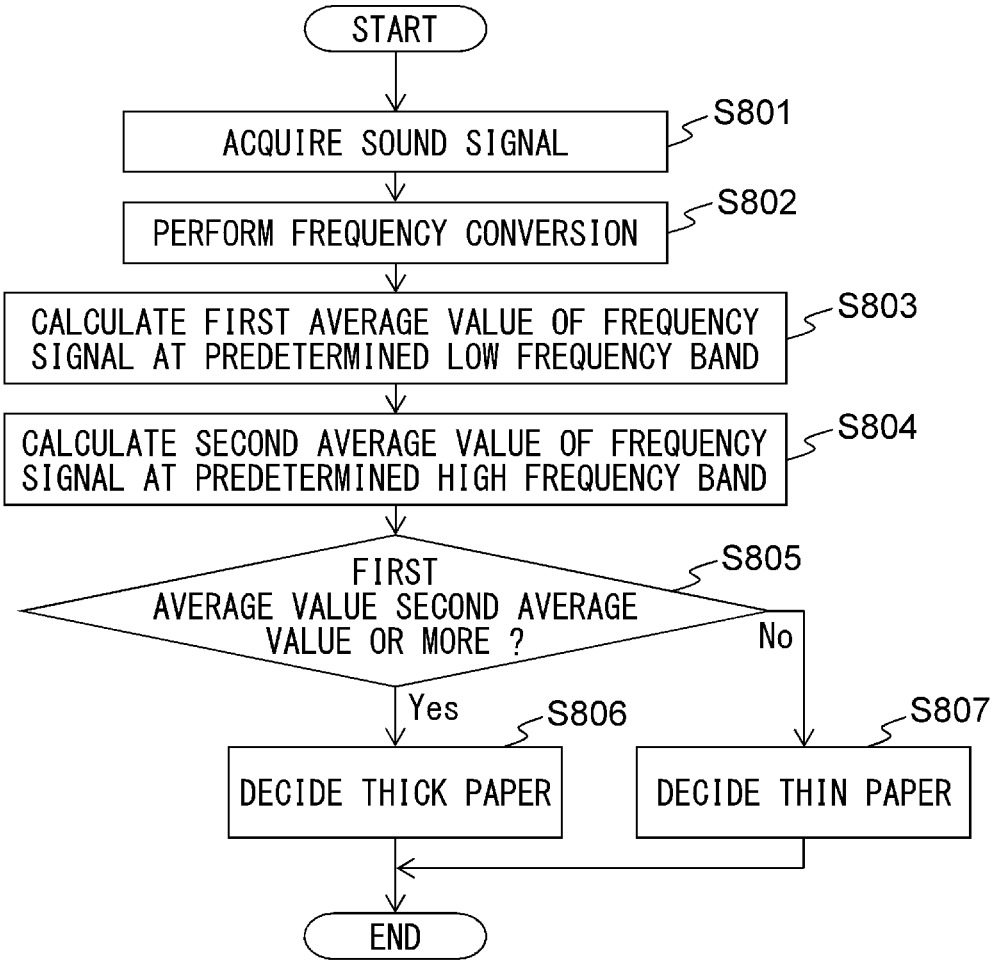
FIG. 17 is a flow chart which shows an example of operation of paper thickness detection processing.

FIG. 17 is a flow chart which shows an example of operation of processing for detection of the thickness of the paper of the paper conveying apparatus 300.

The flow of operation which is explained below is performed based on a program which is stored in the storage unit 147 in advance mainly by the central processing unit 350 in cooperation with the elements of the paper conveying apparatus 300. This flow chart is followed at the timing when the central processing unit 350 drives the drive unit 145 to rotate the paper feed roller 111 and retard roller 112 and the front end of the paper passes the microphone 114.

First, the paper thickness detector 357 acquires a sound signal for frequency analysis use from the second sound A/D conversion unit 348 (step S801).

Next, the paper thickness detector 357 uses a fast Fourier Transform (FFT) to generate a frequency signal acquired by frequency conversion of a sound signal for frequency analysis use (step S802).

Next, the paper thickness detector 357 calculates the average value of the signal value of the frequency signal at a predetermined low frequency band (for example 200 Hz to 2 kHz) (below, referred to as "the first average value") (step S803).

Next, the paper thickness detector 357 calculates the average value of the signal value of the frequency signal at a predetermined high frequency band (for example 2 kHz to 5 kHz) (below, referred to as "the second average value") (step S804).

Next, the paper thickness detector 357 determines whether the first average value is a second average value or more (step S805).

The paper thickness detector 357 decides that the conveyed paper is thick paper if the first average value is the second average value or more (step S806). On the other hand, it decides that the conveyed paper is thin paper if the first average value is less than the second average value (step S807) and ends the series of steps.

The frequency determination module 156 determines the pass band which is passed by the analog filter 142 in accordance with the results of detection by the paper thickness detector 357 whether the paper is thick paper or thin paper and sets the bandpass filter of the analog filter 142 to the bandpass filter which corresponds to the pass band.

Note that, in the paper conveying apparatus 300, the signal which is output by the microphone 114 is used for both the processing for detection of the thickness of the paper and processing for detection of a sound jam. That is, sometimes the flow chart of the sound jam detection processing which is shown in FIG. 6 is followed in parallel with the flow chart which is shown in FIG. 17. However, the processing for detection of the thickness of the paper is completed in a sufficiently shorter time than sound jam detection processing and after that the bandpass filter of the analog filter 142 is immediately set, so the sound jam detector 153 can determine any occurrence of a jam based on a sound signal with a small effect of noise at the majority of the sound jam detection processing.

Note that, when the analog filter 142 is provided with three or more bandpass filters, the paper thickness detector 357 may classify the thickness of the conveyed paper to the same number of classes as the number of bandpass filters. In this case, instead of steps S803 to S804, the paper thickness detector 357 calculates the average values of the signal values of the frequency signals at the pass bands of the respective bandpass filters. Further, instead of the processing of steps S805 to S807, the paper thickness detector 357 finds the bandpass filter with the pass band where the calculated average value becomes the largest and determines that the thickness of the conveyed paper is the thickness which corresponds to the bandpass filter.

As explained above in detail, the paper conveying apparatus 300 can use the paper thickness detector 357 which is loaded as a functional module of the central processing unit 350 so as to detect the thickness of the conveyed paper, so can eliminate the effects of noise for paper of various thicknesses and can precisely determine any occurrence of a jam by the sound which the paper generates. Further, since the paper conveying apparatus 300 detects the thickness of the paper based on the sound signal, special hardware for detecting the thickness of the paper becomes unnecessary and the hardware cost can be reduced.

Figure 18:
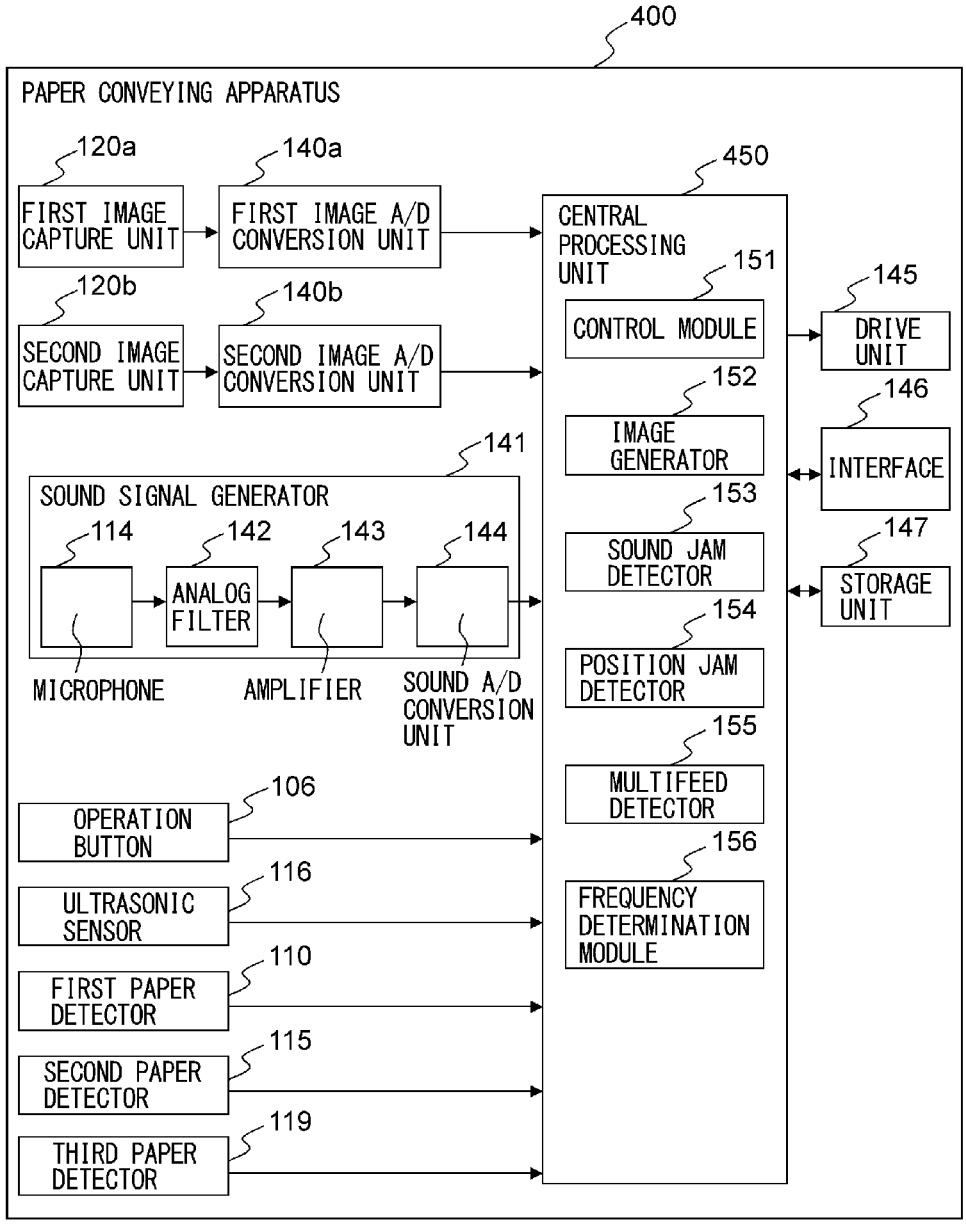
FIG. 18 is a block diagram which shows a schematic configuration of a paper conveying apparatus 400 according to still another embodiment.

FIG. 18 is a block diagram which shows a schematic configuration of a paper conveying apparatus 400 according to still another embodiment.

The paper conveying apparatus 400 which is shown in FIG. 18 utilizes the interface 146 for receiving information specifying a thickness of a paper from the information processing apparatus 10 instead of the paper thickness detector 113 of the paper conveying apparatus 100 which is shown in FIG. 3.

Figure 19:
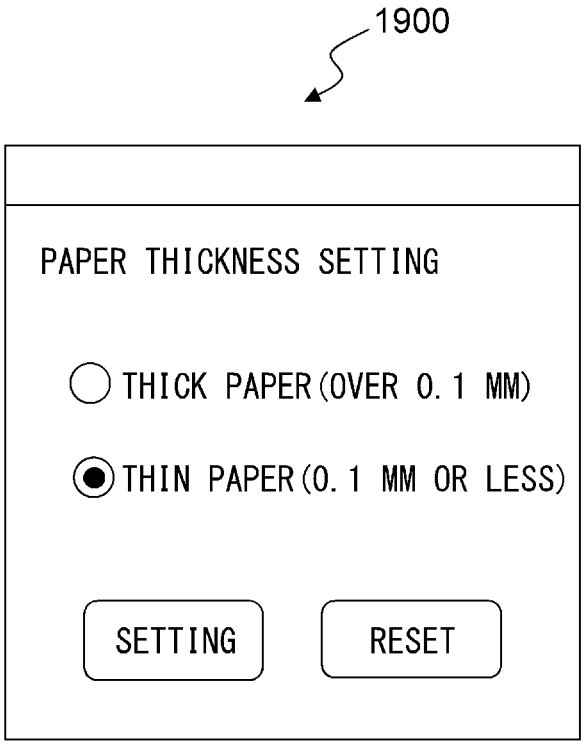
FIG. 19 is a view which shows an example of a screen for setting paper thickness.

FIG. 19 shows an example of the settings screen of paper thickness which is displayed by the information processing apparatus 10.

As shown in FIG. 19, at the settings screen 1900, selection buttons are displayed for a user to select whether the conveyed paper is thick paper or thin paper. If whether the conveyed paper is thick paper or is thin paper is selected by the user, the information processing apparatus 10 transmits paper thickness information which shows which of thick paper and thin paper has been selected to the paper conveying apparatus 400.

When the interface 146 of the paper conveying apparatus 400 receives paper thickness information from the information processing apparatus 10, it sends the received paper thickness information to the frequency determination module 156. The frequency determination module 156 determines the pass band to be passed by the analog filter 142 according to which of thick paper and thin paper is indicated in the paper thickness information which is received from the interface 146 and sets the bandpass filter of the analog filter 142 to the bandpass filter which corresponds to that pass band. That is, in the paper conveying apparatus 400, the interface 146 functions as a paper thickness setting module for receiving information specifying the thickness of the paper.

Note that, the information processing apparatus 10 may display on the settings screen 1900 which is shown in FIG. 19, instead of the selection buttons, a box for the user to directly enter the thickness of the conveyed conveyed paper, and send the thickness of the paper which is entered by the user as the paper thickness information to the paper conveying apparatus 400. In this case, the frequency determination module 156 of the paper conveying apparatus 400 determines the pass band to be passed by the analog filter 142 from the thickness of the paper which is shown in the paper thickness information which is received from the interface 146.

Note that, the paper conveying apparatus 400 may also, instead of acquiring paper thickness information through the interface 146 from the information processing apparatus 10, be provided with a display unit and an operation unit, display a settings screen of the paper thickness on the display unit, and receive information specifying the thickness of the paper through the operation unit.

As explained above in detail, the paper conveying apparatus 400 can use the interface 146 to acquire the thickness of the conveyed paper, so can eliminate the effects of noise for paper of various thicknesses and can precisely determine any occurrence of a jam by the sound which the paper generates.

Figure 20:
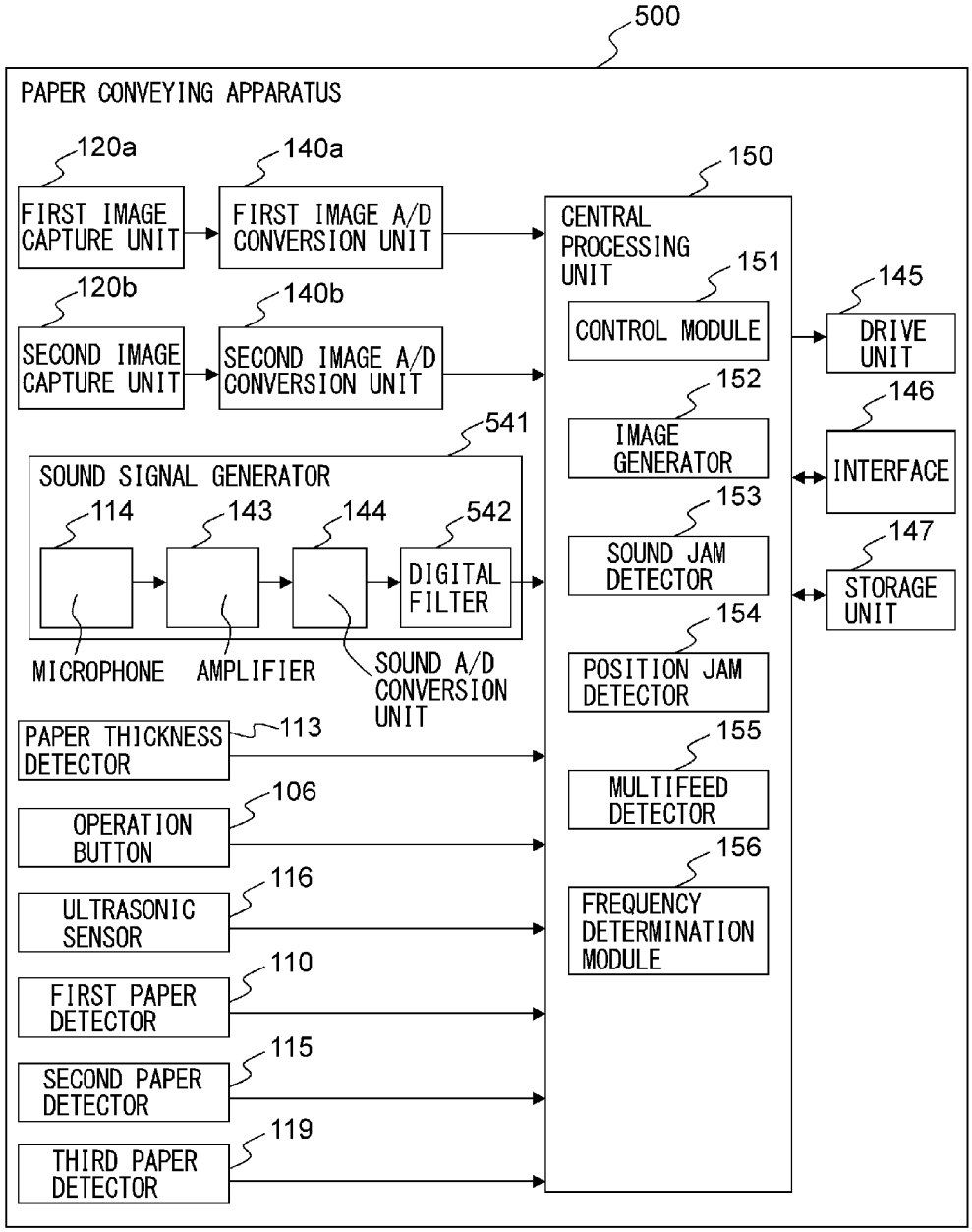
FIG. 20 is a block diagram which shows a schematic configuration of a paper conveying apparatus 500 according to still another embodiment.

FIG. 20 is a block diagram which shows a schematic configuration of a paper conveying apparatus 500 according to still another embodiment.

The paper conveying apparatus 500 which is shown in FIG. 20 has a digital filter 542 instead of the analog filter 142 of the paper conveying apparatus 100 which is shown in FIG. 3 and applies a bandpass filter not to an analog signal but to a digital signal.

In the paper conveying apparatus 500, the amplifier 143 amplifies the analog signal which is output from the microphone 114 and outputs it to the sound A/D conversion unit 144. The sound A/D conversion unit 144 converts the analog signal which is output from the amplifier 143 to a digital signal and outputs it to a digital filter 542.

The digital filter 542 is provided with a plurality of bandpass filters which pass signals of respectively different frequency bands determined in advance. It applies a bandpass filter which is set by the central processing unit 150 to the digital signal which is output from the sound A/D conversion unit 144 and outputs it to the central processing unit 150. Note that, the digital filter 542 may also be provided with just one bandpass filter and be configured so that the frequency band which the bandpass filter passes is set by the central processing unit 150.

The frequency determination module 156 determines the pass band to be passed by the digital filter 542 in accordance with the thickness of the conveyed paper and sets the bandpass filter of the digital filter 542 to the bandpass filter which corresponds to that pass band.

Note that, when generating a frequency signal like the paper conveying apparatus 300 which is shown in FIG. 16, the paper conveying apparatus 500 may also utilize the generated frequency signal to generate a sound signal of a specific frequency band instead of applying a bandpass filter to the signal which is output from the microphone 114. In this case, the central processing unit 150 can extract from the generated frequency signal the component of the frequency band which the frequency determination module 156 determines and convert the extracted component to the inverse frequency using inverse fast Fourier transform so as to generate a sound signal of the time region of the frequency band which the frequency determination module 156 determines.

As explained above in detail, the paper conveying apparatus 500 can use a digital filter 542 to cut the component of a specific frequency band of a sound signal, so can eliminate the effects of noise for paper of various thicknesses and can precisely determine any occurrence of a jam by the sound which paper generates.

According to the paper conveying apparatus and the jam detection method, and the computer-readable, non-transitory medium, it is possible to precisely determine any occurrence of a jam by a sound which is generated by paper for various types of paper.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a sound signal generator, provided with a sound detector near a conveyance path of a paper, for generating a sound signal corresponding to a sound generated by a paper during conveyance of the paper;

a paper thickness setting module for setting a thickness of a paper conveyed to the conveyance path; and a sound jam detector for determining whether a jam has occurred based on a specific frequency band in the sound signal, wherein the sound jam detector decides that the specific frequency band is a first frequency band when the thickness of the paper is a first thickness, and decides that the specific frequency band is a second frequency band higher than the first frequency band when the thickness of the paper is a second thickness thinner than the first thickness.

2. The paper conveying apparatus according to claim 1, wherein the paper thickness setting module comprises a paper thickness detector for detecting the thickness of the paper conveyed to the conveyance path.

3. The paper conveying apparatus according to claim 1, wherein the paper thickness setting module generates a frequency signal converted from the sound signal, decides that the thickness of the paper is the first thickness when a first average value of the frequency signal at a third frequency band is equal to or more than a second average value of the frequency signal at a fourth frequency band higher than the third frequency band, and decides that the thickness of paper is the second thickness when the first average value is less than the second average value.

4. The paper conveying apparatus according to claim 1, wherein the paper thickness setting module comprises an interface for receiving information specifying the thickness of the paper conveyed to the conveyance path.

5. A jam detection method comprising:

acquiring a sound signal from a sound signal generator provided with a sound detector near a conveyance path of a paper, the sound signal corresponding to a sound generated by a paper during conveyance of the paper;

setting a thickness of a paper conveyed to the conveyance path; and determining, by a computer, whether a jam has occurred based on a specific frequency band in the sound signal, wherein the computer decides that the specific frequency band is a first frequency band when the thickness of the paper is a first thickness and decides that the specific frequency band is a second frequency band higher than the first frequency band when the thickness of the paper is a second thickness thinner than the first thickness, in the determining step.

6. A computer-readable, non-transitory medium storing a computer program, wherein the computer program causes a computer to execute a process, the process comprising:

acquiring a sound signal from a sound signal generator provided with a sound detector near a conveyance path of a paper, the sound signal corresponding to a sound generated by a paper during conveyance of the paper;

setting a thickness of a paper conveyed to the conveyance path; and determining whether a jam has occurred based on a specific frequency band in the sound signal, wherein the computer decides that the specific frequency band is a first frequency band when the thickness of the paper is a first thickness and decides that the specific frequency band is a second frequency band higher than the first frequency band when the thickness of the paper is a second thickness thinner than the first thickness, in the determining step.

* * * * *